United States Patent [19]

Gulla

[11] 4,061,588

[45] * Dec. 6, 1977

[54] CATALYST COMPOSITION AND METHOD OF PREPARATION

[75] Inventor: Michael Gulla, Sherborn, Mass.

[73] Assignee: Shipley Company Inc., Newton, Mass.

[ * ] Notice: The portion of the term of this patent subsequent to Apr. 26, 1994, has been disclaimed.

[21] Appl. No.: 618,034

[22] Filed: Sept. 30, 1975

[51] Int. Cl.[2] ..... B01J 31/30

[52] U.S. Cl. ..... 252/429 R; 252/436; 252/438P; 252/441; 106/1.11; 427/98; 427/304; 427/305; 427/306

[58] Field of Search ..... 252/429 R, 441, 436, 252/438; 106/1; 427/306, 305, 304, 98

[56] References Cited

U.S. PATENT DOCUMENTS

| | | | |
|---|---|---|---|
| 3,011,920 | 12/1961 | Shipley | 427/98 |
| 3,672,923 | 6/1972 | Zeblisky | 106/1 X |
| 3,874,882 | 4/1975 | Gulla et al. | 106/1 |
| 3,904,792 | 9/1975 | Gulla et al. | 427/304 |

*Primary Examiner*—Patrick P. Garvin

*Attorney, Agent, or Firm*—Dike, Bronstein, Roberts, Cushman & Pfund

[57] ABSTRACT

This invention relates to dry catalyst compositions of catalytic metals and to methods for formation of said dry compositions. The dry catalysts, upon dispersion in an aqueous acid solution, are used to render surfaces receptive to the deposition of an electroless metal. The liquid catalyst compositions from which the dry compositions are formed, are those catalyst formulations of U.S. Pat. Nos. 3,874,882 and/or 3,904,792.

59 Claims, 2 Drawing Figures

CATALYST COMPOSITION AND METHOD OF PREPARATION

BACKGROUND OF THE INVENTION

1. Introduction

This invention relates to electroless metal deposition and more particularly, to catalytic compositions useful therefor.

2. Description of the Prior Art

Electroless metal deposition refers to the chemical deposition of a metal on a conductive, non-conductive, or semi-conductive substrate in the absence of an external electric source.

Electroless deposition is used for many purposes, for example, in the manufacture of printed circuit boards where, in one method, an electroless metal, typically copper, is deposited on a dielectric substrate either as a uniform surface coating or in a predetermined pattern. This initial electroless deposit is usually thin and may be further built up by electroplating or may be deposited directly to full thickness.

The substrate over which an electroless metal deposit is formed is most often a plastic panel which may have a metal foil such as copper laminated to one or both of its surfaces, for example, with adhesive, to form a metal clad substrate. Where both surfaces of the substrate are to be used, connections are typically provided therebetween by means of holes through the panel at appropriate locations, the walls of these holes being made conductive with the electroless coating.

The electroless deposition of a metal on either a metallic or non-metallic substrate usually requires pretreatment or sensitization of the substrate to render it catalytic to the reception of such a deposit. Various methods have evolved over the years employing particular sensitizing compositions.

An early method of sensitization involves plural baths wherein a substrate is subjected first to immersion in an acidic stannous chloride solution and, following water rinsing, immersion in an acidic palladium chloride solution whereby the palladium chloride is reduced to a catalytic layer of palladium metal. This method has severe limitations because the palladium chloride solution, in contact with the copper layer of a copper clad substrate, forms an immersion deposit which is loosely adhered to the copper. This is wasteful of palladium and interferes with the bond between the copper cladding and a subsequently deposited electroless metal layer.

A major advance in the art of electroless metal deposition was achieved by the compositions and processes of U.S. Pat. No. 3,011,920 incorporated herein by reference. According to said patent, a substrate was catalyzed by treatment with a liquid which contained a colloidal dispersion of a catalytic metal formed by the admixture of catalytic metal ions and stannous ions in an amount in excess of the catalytic metal ions in an acidic aqueous solution. The colloid is believed to be of catalytic reduced metal having a protective colloid comprising stannic acid. By this method, the immersion coating formed by contact of palladium ions with copper cladding was eliminated as the catalytic metal is not in an ionic form, but rather, is in colloidal form, where the colloid is believed to be in an insolubilized reduced form of the catalytic metal. Other advantages were achieved with the invention of U.S. Pat. No. 3,011,920 such as decreased cost resulting from reduction in the amount of catalytic metal consumed, improved coating, improved bond strength between coating and substrate, greater reliability and other improvements as enumerated in said patent.

In U.S. Pat. No. 3,672,938, there is disclosed a process for catalyzing a substrate prior to electroless metal deposition and catalyst compositions therefor which compositions are also formulated by the admixture in acid solution of a catalytic metal salt, a stannous salt in molar excess of the catalytic metal salt and a hydrohalide acid. This catalyst is said to differ from the catalysts of U.S. Pat. No. 3,011,920 in physical form, it being asserted that the catalyst of said patent is an optically clear "true solution catalyst" of unreduced catalytic metal in complex form rather than a colloidal catalyst of reduced catalytic metal as in the aforesaid U.S. Pat. No. 3,011,920.

Improvements over catalysts disclosed in U.S. Pat. No. 3,011,920 and 3,672,938 are disclosed in U.S. Pat. Nos. 3,874,882 and 3,904,792. The inventions of these latter patents are predicated upon the discovery that urea addition to such catalysts minimizes stannous ion oxidation loss and consequently, catalyst instability; and halide ions play a significant roll in the functioning of such catalysts, the catalyst being improved when the concentration of halide ions is increased beyond that concentration found in the prior art catalysts by the addition of an extraneous source of halide ions. Therefore, the improvements resulting from the addition of urea to catalyst formulations and/or excess halide ions comprise improved stability and adsorption properties, and solubilization of the stannous salt or retardation of the point wherein the catalyst coagulates and precipitates. Accordingly, catalysts of increased stability and pH can be formulated thereby providing catalysts suitable for use with materials readily attacked by strong acids.

For purposes of economy in shipping and storage, it is desirable to provide a catalyst in dry form which can be redispersed by simple admixture with an aqueous acidic solution. With reference to the catalysts of U.S. Pat. No. 3,011,920, it was believed that the catalysts thereof could not be dried and redispersed. This belief was due in part to stability tests where catalyst was left exposed in an open container with a large surface area, such as a petri dish. In these tests, it was found that with standing and evaporation of the liquid components of the catalyst, the catalyst would coagulate prior to complete drying and once coagulated, could not be redispersed.

In the prior art, one attempt at production of a dry catalyst material is reported in U.S. Pat. No. 3,672,923 wherein the catalysts of U.S. Pat. No. 3,672,938 are produced in dry form. These dry catalysts, and the liquid catalysts from which they are formed, are reported to be complex, optically clear, non-colloidal "true solution catalysts" of unreduced catalytic metal ions when in aqueous acidic medium as distinguished from colloidal catalysts. In said U.S. Pat. No. 3,672,923, it is reported that because the catalysts are true solution complexes, they can be dried to powder form whereas a colloidal catalyst could not be similarly dried. A typical reported method for making a complex catalyst, as distinguished from a colloidal catalyst, and drying the same is set forth in Example 3 of the patent wherein stannous chloride is dissolved in 37% hydrochloric acid, diluted, and admixed with palladium chloride. This mixture is heated to 85° C for 20 minutes, then boiled for 1.5 hours, cooled and vacuum evaporated to dryness. It is reported that this procedure forms a true solution complex catalyst.

In copending U.S. Patent Application Ser. No. 618,033 filed contemporaneously herewith, dry catalyst compositions are reported that upon dispersion in an aqueous acidic solution of pH below about 1, have substantially the composition of the acidic catalysts of U.S. Pat. No. 3,011,920. These catalytic compositions, both in dry and in suspended form, are believed to be of reduced colloidal catalytic metal. The dry compositions are made either from the liquid catalysts compositions of said U.S. Pat. No. 3,011,920 using methods that avoid aerial oxidation of stannous tin or by replenishing dry catalyst compositions that have undergone aerial oxidation with an additional stannous salt, or the dry catalyst composition may be made directly from the solid components of the catalyst in dry form.

SUMMARY OF THE INVENTION

The present invention provides dry catalyst compositions which, upon dispersion in an aqueous acidic solution of pH below about 3.5, have substantially the compositions of the catalyst of U.S. Pat. Nos. 3,874,882 and/or 3,904,792. The dry catalyst composition may be made either by drying the corresponding liquid catalyst compositions, preferably using methods that avoid aerial oxidation or, if aerial oxidation cannot be avoided, by replenishing the dry catalyst compositions that have undergone aerial oxidation with stannous salt to the extent required, or said dry catalyst compositions may be made directly from solid components of the catalyst in dry form.

Definitions

The following definitions are provided to assist in the understanding of the ensuing text:

"The 3,874,882 patent" refers to U.S. Pat. No. 3,874,882.

"The 3,904,792 patent" refers to U.S. Pat. No. 3,904,792.

"Catalyst formulation" is the product resulting from the admixture of an acid soluble salt of a catalytic metal, a stannous salt in molar excess of the catalytic metal salt, an acid, and, where the text so indicates, urea and/or an extraneous source of halide ions.

"Dry catalyst formulation" means catalyst formulation in the form of dry solid material that may be completely dry, but preferably contains a moisture content of from 2 to 25% by weight and more preferably, a moisture content of from 5 to 15%.

"Catalyst component" refers to any one or more of the salts of the catalytic metal, stannous salt or acid used in making either the catalyst formulation or the dry catalyst formulation.

"Actual halide ion concentration" is the concentration of halide ions in the catalyst formulation, if any, of the catalyst components used in the form of a halide. This will be zero if none of the aforesaid components are used in the form of a halide. "Maximum component halide ions concentration" is the concentration of halide ions that would be in the catalyst formulation if each of the catalyst components were used in the form of a halide.

"Total halide ion concentration" is the required amount of halide ion in the catalyst formulation.

"Extraneous halide ion" and the like terms mean a source of halide ions in addition to those supplied by the catalyst components. "Extraneous halide salt" means the source of the extraneous halide ions. The concentration of the extraneous halide ions is equal to the difference between the total halide ion concentration and the actual halide ion concentration.

"Excess halide ions" are halide ions in the catalyst in excess of the maximum component halide ion concentration and the concentration of the excess halide ions is equal to the difference between the total halide ion concentration and the maximum component halide ion concentration. The concentration of the excess halide ions equals the concentration of the extraneous halide ions when all catalyst components used to make the catalyst are in the form of a halide.

"Precipitation point" is the pH at which a precipitate forms in the catalyst formulation rendering the catalyst unsuitable for use. This precipitate is believed to be coagulated catalyst products including hydrolysis products, principally of the stannous salt.

DESCRIPTION OF THE DRAWINGS

In the drawings, FIG. 1 graphically represents precipitation point of a series of catalysts as a function of pH.

DESCRIPTION OF THE PREFERRED EMBODIMENTS

Figure 1:
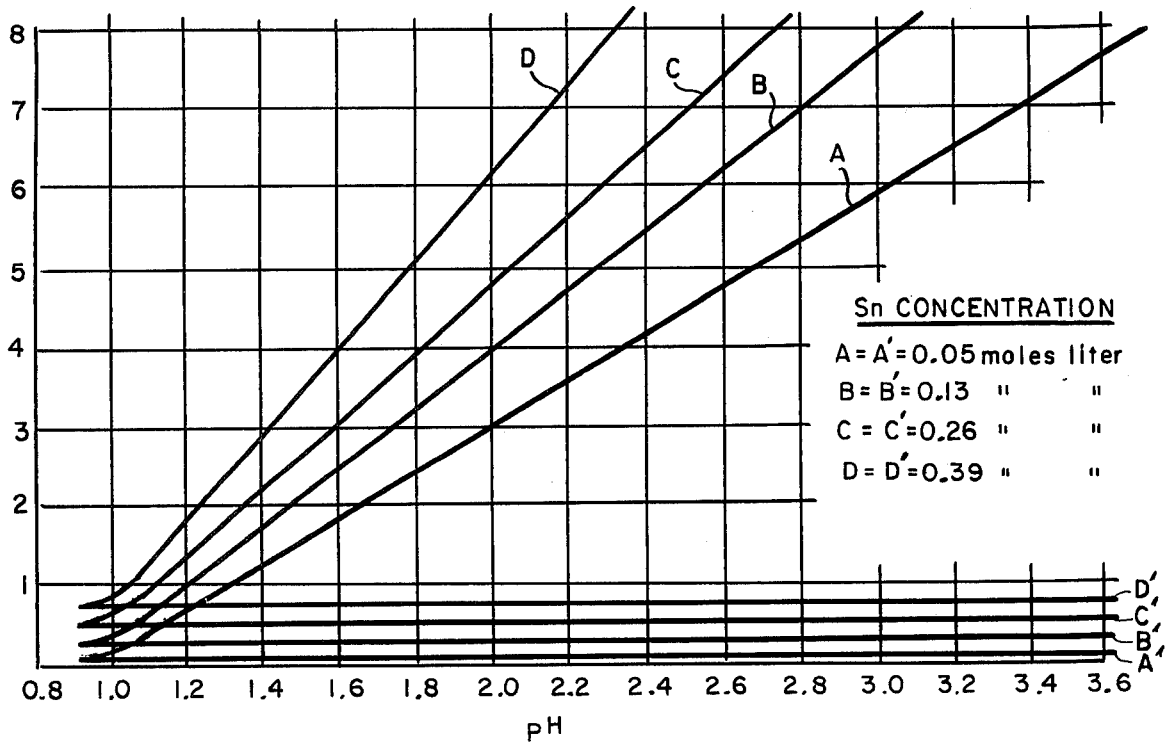

In accordance with this invention, dry catalysts are provided which, upon admixture with an acidic solution having a pH below about 3.5, provide operative catalyst formulations substantially corresponding to those liquid compositions described in the 3,874,882 and 3,904,792 patents. Such liquid compositions comprise (1) an acid soluble salt of a catalytic metal, (2) a stannous salt soluble in aqueous solution in molar excess of the catalytic metal, (3) an acid and (4) an extraneous source of halide ions in an amount sufficient to provide an excess of halide ions in the formulation and/or urea. If urea is present, the stannous salt, acid and urea is believed to form an addition product as described in the 3,874,882 patent.

The acid soluble salt of the catalytic metal used to form the catalysts of the 3,874,882 patent and the 3,904,792 patent, as well as the dry catalyst formulations of this invention, is a salt of any of those metals known to exhibit catalytic properties in chemical plating. Such metals include the precious metals, gold and silver, and members of the platinum family. Palladium is generally found to be the most satisfactory of these catalytic metals for the activation of a non-conducting substrate, particularly a plastic substrate, and therefore, use of this metal constitutes the preferred embodiment. Silver, gold and rhodium constitute lesser preferred embodiments as some difficulty is encountered in the preparation of the catalyst due to limited solubility of the silver salts and instability of the gold and rhodium salts in solution.

The particular salt of the catalytic metal used is not critical and may comprise the halides, such as those described in U.S. Pat. No. 3,011,920; as well as such other salts as the nitrate, sulfate and the like. Fluoride and iodide salts are lesser preferred. Salts other than the halides are suitable, particularly if halide ions are introduced into solution by the extraneous source of halide ions. Preferably, the salt is the halide having an anion common to that of the other catalyst components. It should be noted that when the halide salt is used, some halide is introduced into solution, but because of the low concentration of the catalytic metal salt used, this amount is generally negligible.

The amount of the catalytic metal salt is not critical and is primarily governed by cost and functional considerations. Thus, though up to 40 to 50 grams per liter or more of the catalytic metal salt is possible, it is desirable to maintain the quantity of the salt as low as possible from a cost consideration without sacrificing the functional properties of the catalytic formulation. Typically, the amount of the catalytic metal salt in the composition does not exceed 8 grams per liter and in a made-up bath, does not exceed 2 grams per liter of solution and more preferably ranges between about 0.1 and 1 gram per liter of solution.

The particular stannous salt used to formulate the catalyst is likewise not critical and in addition to a stannous halide, other stannous salts are suitable such as stannous nitrate and stannous acetate. As with the salt of the catalytic metal, the stannous halide having an anion common to that of other catalyst constituents is preferred. When a stannous halide is not used, a source of halide ions is preferably introduced into the catalyst formulation though this amount by itself does not provide sufficient halide ions for formation of a satisfactory catalyst having a pH above 1.

The amount of stannous salt used is not critical provided stannous ions are present in the catalyst formulation in molar excess of the catalytic metal ions. In this respect, the molar ratio of the stannous ion to the catalytic metal ion may be as low as 1:1, preferably is at least 5:1, and more preferably varies between 10:1 and 50:1 though it may be as high as 100:1.

The hydrohalide acids, other than hydriodic acid, are preferred. However, results in terms of stability and catalytic activity with hydrofluoric acid are marginal. Hydrobromic acid is better and hydrochloric acid provides the best result. Accordingly, the term hydrohalide acid as used herein is intended to mean principally hydrochloric acid, but also includes hydrohalide acids other than hydriodic acid with the realization that these other acids provide marginal results. It should be further realized that the term hydrohalide acid means the presence of hydrogen ions and halide ions in solution though the hydrogen ions may be derived from any other acid that does not have an anion detrimental to the catalyst formulation. Thus, sulfuric acid, fluoroboric acid and various organic acids such as maleic acid, as examples, may be used, as a source of hydrogen ions with all of the halide ions. Nitric acid should not be used if urea is added to the formulation as it forms an insoluble addition product with urea. Likewise, other acids which form insoluble addition products with urea should be avoided.

The amount of acid used may be substantially less than in the commercially acceptable formulations of the prior art. In the prior art, the concentration of the acid had to be sufficiently high as to provide a catalyst having a pH of less than 1 and typically was so high as to provide a catalyst having a pH below the mathematically defined lower limit of 0. Using hydrochloric acid as an example, as much as 12 moles per liter of solution were used. Though such high concentrations of acid can be used, the acid concentration can be reduced to a level whereby the pH of the catalyst is as high as 3.5. Accordingly, the amount of acid used is that amount that results in a solution pH of no greater than 3.5 though the concentration may be to saturation. Preferably, the acid is used in an amount sufficient to provide a pH ranging up to 2.5. It should be noted that though catalysts can be formulated with a pH as high as 3.5, this is principally accomplished when the stannous ion concentration is relatively low and the halide ion concentration is relatively high. Consequently, the stability of catalysts at this high pH is not entirely satisfactory for storage of catalyst for long periods of time.

When urea is used in the catalyst formulation, it is believed that an addition product is formed which utilizes one mole of the acid and one mole of the stannous compound. Consequently, an excess of that amount of urea needed to complex all of the stannous is preferred relative to the other constituents although less than equimolar amounts provide some benefits. The ratio of urea to the hydrohalide acid may vary between 1:10 and 100:1, but preferably varies between 1:1 and 10:1. From the standpoint of volume only, more urea may be used as the pH of the solution increases and the volume of acid required decreases.

Though the aforesaid description has referred only to urea, it should be understood that halides of urea may also be used though these materials are less desirable as they are hydroscopic and therefore present difficulty in terms of raw materials, storage, particularly in dry catalyst form. They are, however, included and the term urea as used herein refers both to urea and its halides.

From the above description, it can be seen that all of the catalyst components--i.e., the catalytic metal salt, urea, the stannous salt and the acid, may or may not be used in the form of their respective halides though in a preferred embodiment, they are all halides having a common anion, most preferably chloride. With reference to the definitions set forth above, if all catalyst components were in the form of the halide, the resulting halide concentration, referred to as the maximum component halide ion concentration, would not be sufficiently high to obtain the improvements in the stability and adsorption properties and the retarded precipitation point. Obviously, if one or more of the catalyst components were used in a form other than the halide, then the actual halide ion concentration would still be insufficient to obtain the improvements noted above.

In accordance with the preferred embodiments, an excess of halide ions is provided in the catalyst formulation, above the maximum component halide ion concentration, by the addition of an extraneous source of halide ion. The amount of extraneous halide ion added is equal to at least the difference between the actual halide ion concentration and the required total halide ion concentration.

In determining the required total halide ion concentration for the liquid catalyst compositions, different considerations apply dependent upon whether the pH of the catalyst is below or above the precipitation point, the pH at which a precipitate forms which precipitate is believed to be insoluble hydrolysis products of tin and coagulated catalytic metal.

With regard first to liquid catalyst formulations having a pH below the precipitation point in the absence of the extraneous halide ions, the total halide ion concentration required is not critical, it being understood that the higher the total halide ion concentration, the greater will be the stability and adsorption properties of the catalyst though the improvements in these properties are sometimes difficult to ascertain, especially with those catalysts having a high hydrogen ion concentration—e.g., a concentration such that the pH of the catalyst is mathematically below 0. In general, at a pH below the precipitation point, the total halide ion concentration is at least 0.2 moles in excess of the maximum potential halide ion concentration and preferably, at least 0.5 moles in excess. The maximum concentration is not critical and the total halide ion concentration can be at saturation. Accordingly, the range for the total halide ion concentration is from an excess halide ion concentration of at least 0.2 moles to saturation and preferably at least 0.5 moles to saturation. The concentration of the extraneous source of halide ions is that amount necessary to increase the actual concentration of the halide ions to the total concentration of halide ions required as described above. Obviously, a greater amount of extraneous halide ions will be required when one or more of the catalyst components such as the catalytic metal salt, the stannous salt or the acid is not in the form of the halide.

Figure 2:
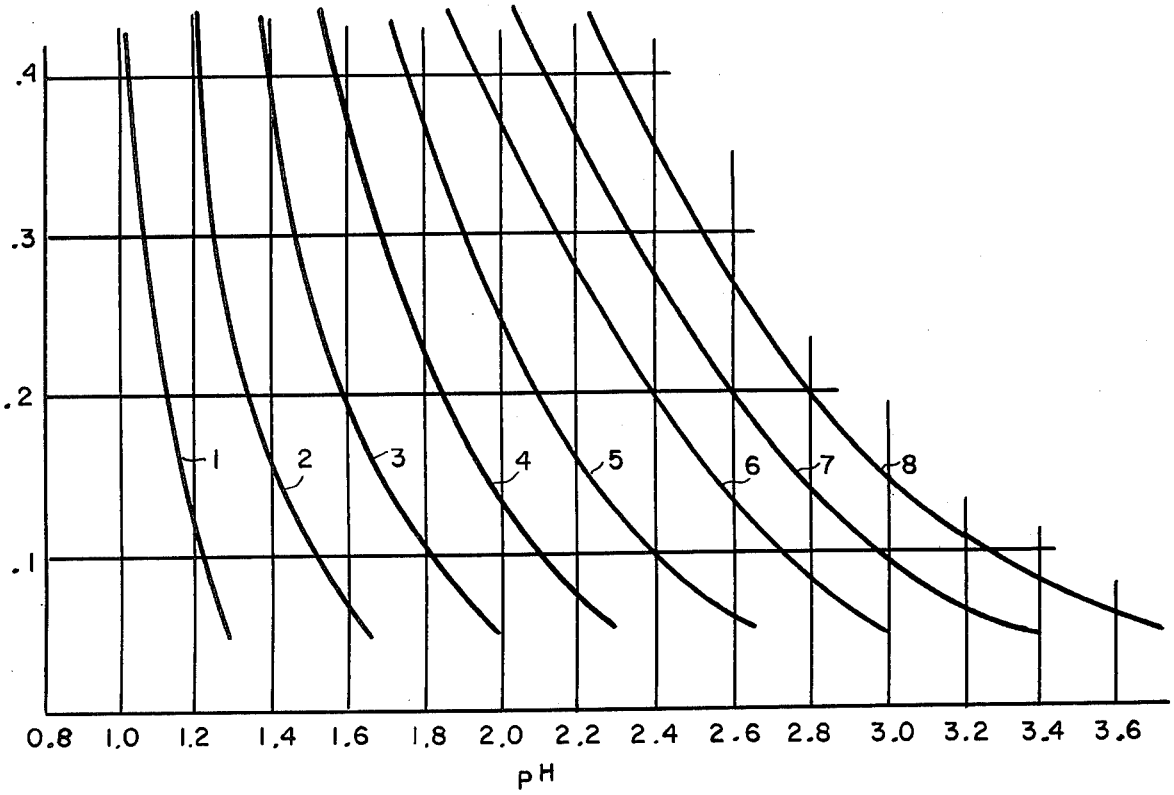
FIG. 2 graphically represents the precipitation point of a series of catalysts as a function of stannous ion concentration.

With regard to liquid catalyst formulations having a pH above the precipitation point (in the absence of an extraneous source of halide ions), the amount of excess halide ion is more difficult to define as it is dependent upon the pH of the catalyst and the concentration of the stannous ions. The relationship between total halide ion concentration, pH and stannous ion content is depicted in FIGS. 1 and 2 of the drawings for the system palladium chloride (1 gram per liter of solution), stannous chloride, hydrochloric acid and lithium chloride as the source of the extraneous ions. It should be understood that other systems are similar to this system though the numerical limitations defining the curves might differ.

In FIG. 1 of the drawings which is reproduced from the 3,907,792 patent, there is depicted two families of curves. The first family comprises curves A, B, C and D which represent the change in the precipitation point of a liquid catalyst (pH) as a function of total chloride ion concentration for several different stannous ion concentrations. The second family of curves, A', B', C' and D' represent the actual chloride ion concentration derived from the total of the catalyst components—the stannous chloride, palladium chloride and hydrochloric acid, but not the lithium chloride. Curves A and A' are for a stannous ion content of 0.05 moles per liter of solution, B and B' for 0.13 moles per liter of solution, C and C' for 0.26 moles per liter of solution and D and D' for 0.39 moles per liter of solution. The precipitation point for this catalyst system in the absence of any extraneous halide ions (lithium chloride) is at a pH of about 0.9. As extraneous chloride ions are introduced into the system and the total chloride ion concentration is increased, the precipitation point (pH) is also increased, but not as rapidly for formulations having a high stannous ion concentration (Curve D) as for formulations having a low stannousion concentration (Curve A). Thus, it can be seen that the highest pH (about 3.5) is obtainable only with the lowest concentration of stannous ion and the highest total concentration of chloride ion. As the total chloride ion concentration decreases or the stannous ion concentration increases, the highest possible pH decreases.

The curves of FIG. 1 represent precipitation point. Therefore, the area above any given curve represents a stable catalyst while the area below the curve represents a catalyst containing a precipitate that is of no commercial value.

FIG. 1 may be used to determine the amount of extraneous halide ion required for the liquid catalyst formulation. This is determined from the concentration difference between curves at any given pH and stannous ion concentration. For example, at a pH of 2 and a stannous ion concentration of 0.26 moles per liter of solution (Curves C and C'), the concentration difference between curves C and C' is about 4.5 so that the concentration of extraneous chloride ions required to reach the precipitation point is 4.5 moles per liter of solution. Thus, 4.5 moles of lithium chloride are added to the formulation to provide a total chloride ion concentration of about 5 moles per liter of solution. However, this chloride ion concentration is only sufficient to reach the precipitation point of the catalyst and the total chloride ion concentration should be in excess of this amount to provide a stable catalyst. In general, for this catalyst system and others within the scope of the invention, the total halide ion concentration should be at least about 0.2 moles per liter of solution above the halide ion concentration at the precipitation point of the catalyst and preferably at least above 0.5 moles per liter of solution above that required at the precipitation point. The upper limit is not critical and can be the saturation point of the halide ion in solution. Applying these general guidelines to the specific formulation depicted in FIG. 1, again making reference to the example at a pH of 2 and a stannous ion concentration of 0.26 moles per liter of solution, the total chloride ion concentration at the precipitation point is 5 moles per liter of solution, but to assure the stability, the total chloride ion concentration should be at least 5.2 moles per liter of solution and preferably at least 5.5 moles per liter of solution. Accordingly, the concentration of the extraneous chloride ions—the lithium chloride, added to the formulation should be more than 4.5 moles per liter of solution, preferably should be at least 4.7 moles per liter of solution and more preferably, should be at least 5.0 moles per liter of solution.

With respect to FIG. 1 described above, lithium chloride was selected as the source of the extraneous chloride ion because of its very high solubility in solution. Other halide salts are not so soluble. For example, when sodium chloride is selected as a source of extraneous chloride ion, the solution becomes saturated when the total concentration is about 4.5 moles per liter. This puts a practical limitation on the maximum pH obtainable as FIG. 1 indicates that when the formulation contains 0.39 moles per liter of solution of stannous ion, the maximum obtainable pH with 4.5 moles of total chloride ion is about 1.65. When the solution contains only 0.05 moles per liter of solution of stannous ion, the maximum possible pH is about 2.5 with 4.5 total moles of chloride ion.

With regard to the source of the extraneous halide ion, any halide salt having the requisite solubility properties is suitable provided it does not have a cation that would interfere with the functioning of the catalyst. In this respect, illustrative halide salts that are suitable include aluminum chloride, aluminum bromide, magnesium chloride, sodium chloride, sodium bromide, potassium chloride, potassium bromide, calcium chloride, calcium fluoride and the like. Lithium halides are preferred because of their solubility and aluminum halides are least preferred because such salts tend to interfere with the functioning of the catalyst.

In FIG. 2 of the drawings, which is also reproduced from the 3,904,792 patent, there is graphically presented a family of curves showing the precipitation point of the aforesaid palladium chloride-stannous chloride-hydrochloric acid catalyst system as a function of the stannous ion concentration at different total halide ion concentrations. Again, the source of the extraneous halide concentration necessary to increase the actual halide ion concentration to the total halide ion concentration is lithium chloride. Each curve in the family of curves is numbered and the numbers proceed from 1 through 8. Each number of the curve is the total halide ion concentration for that curve. Each curve represents the precipitation point of the catalyst under consideration and it should be understood that the region to the left of any given curve represents a useable catalyst and the region to the right of any given curve represents a catalyst in having a pH in excess of its precipitation point and one wherein a precipitate has formed.

From FIG. 2, it can be seen that as the total chlride ion concentration increases, as one progresses from Curve No. 1 to Curve No. 8, the maximum possible pH also increases. It can also be seen that the concentration of the stannous ion becomes more important at the higher pH levels. For example, where the total chloride ion concentration is 8 moles per liter of solution the maximum pH obtainable with 0.4 moles per liter of stannous ion is 2.4 whereas with only 0.5 moles per liter of stannous ion, the minimum pH is in excess of 3.5. Since the curves in FIG. 2 represent precipitation points, a slight excess of total chloride ion concentration beyond that represented in the curve is required to make the catalyst formulation free of a precipitate.

The liquid catalyst formulation from which the dry catalyst formulation is prepared in accordance with this invention, can be made using the procedure of the prior art with the extraneous halide ions dissolved in the acid solution used to dissolve the other catalyst components. When urea is added to the catalyst formulation, the addition product of the stannous salt, acid and urea may be obtained by mixing equimolar amounts of the ingredients together separately and the adduct that forms to the remaining components of the catalyst formulation or all ingredients can be mixed together with formation of the catalyst as taught in the 3,904,792 and 3,874,882 patents. A preferred method for making a catalyst comprises preparing the catalyst in a concentrate form so as to reduce the volume of liquid that must be removed during drying. Moreover, in this way, the concentrate can be made fairly acidic to ensure proper dissolution of the catalyst components and the pH can be readily increased to the extent required. The concentrate is preferably prepared by first dissolving the catalytic metal salt in acid solution, then adding the stannous salt and urea if urea is to be used and letting the formulation age. During aging, the catalyst will turn from a dark blue to green to brown coloration. Following aging, the catalyst can be diluted with a halide solution, for example, if the catalyst is to be used in liquid form, or halide can then be dissolved in the catalyst and then dried or precipitated in accordance with the procedures set forth below.

In one embodiment of this invention, the dry catalyst formulation is prepared from the liquid catalyst formulations described above. Drying preferably takes place under conditions whereby aerial oxidation of excess stannous ions is substantially avoided, though this requirement is not so critical in catalyst formulations containing urea. Drying under conditions to avoid aerial oxidation can be conveniently accomplished by drying the catalyst under vacuum or in an inert atmosphere, preferably at slightly elevated temperatures, e.g., at temperatures ranging between about 90° F and 150° F, though temperatures up to the boiling point of the catalyst composition may be used if care is exercised to prevent over-drying. If it is desired to avoid elevated temperatures, the liquid catalyst can be freeze dried under vacuum. During drying, hydrohalide acid will be evolved which causes the excess stannous ion to dry to stannous halide and hydrolysis products of the stannous ion. The colloidal catalyst is believed to retain its original form—i.e., if in the form of a colloid, the colloid is believed to retain its original reduced catalytic metal form and its protective colloid of stannic acid. If in complex form, according to U.S. Pat. No. 3,672,923, it retains its complex form.

If substantial aerial oxidation of excess stannous ions during drying cannot be avoided, and the stannous ions are not satisfactorily stabilized with urea, the catalyst will contain a substantial concentration of tin, but the tin will be in stannic rather than the necessary stannous form. However, the catalyst can still be fried with oxidation of a stannous and then replenished with a dry stannous salt, preferably a stannous halide, and most preferably stannous chloride. Replenishment is preferably accomplished in the dry stage by blending the dry catalyst product with the stannous salt. Alternatively, replenishment with stannous ions can be achieved by redispersing the dry catalyst product, substantially free of excess stannous salt, in aqueous acid solution containing the dissolved stannous salt. Whether replenishment is accomplished in the dry state or by redispersing the dried catalyst in a liquid medium, the final concentration of the excess stannous should be sufficient to provide a ratio of excess stannous to the catalytic metal of at least 2 to 1, preferably at least 5 to 1, and more preferably, between 10 to 1 and 50 to 1.

In another embodiment of the invention, a dry catalyst product is formed by admixture of a dry salt of the catalytic metal with a dry stannous salt, the stannous salt being in a concentration such that ratio of stannous to catalytic metal is at least 2 to 1, and a member selected from the group of a salt of extraneous halide ions, urea, and mixtures thereof. The salts are wetted with an acid in an amount sufficient to dampen the dry mixture, but not dissolve the dry powders to any appreciable extent. Typically, one milliliter of acid per gram of solids is adequate though this ratio can vary considerably, for example, between about 0.1 ml per gram to 5 ml per gram or more. The mixture is triturated until a homogeneous blend is achieved. It is of interest that the triturate exhibits the color change typically exhibited during the preparation of the liquid catalyst compositions of U.S. Pat. No. 3,011,920. Preferably, following color change to dark brown, the powder mixture is dried in conventional manner. If dried prior to color change, the powder mixture, upon redispersion, will not provide a catalyst that is immediately fully functional, but rather one that becomes fully functional with standing.

The aforesaid method for making a dry catalyst composition provides several advantages. For example, the cost associated with evaporation of large volumes of liquid are avoided. Also, since the liquid catalyst compositions may have a pH well below 1 and must have a pH below 3.5, they are exceedingly corrosive and consequently, special equipment is necessary for drying the same. The admixture of dry powders, as described above, avoids the need for this costly process equipment. Additionally, since large volumes of liquid need not be evaporated from the catalyst during the drying process, there is less opportunity for loss of stannous by aerial oxidation.

The aforesaid process also suffers one disadvantage. The dry powder, upon redispersion in an aqueous acid medium, may not be immediately fully functional, but rather, may have to age for some period of time. For reasons not fully understood, the aging period for this dry catalyst blend following dispersion is somewhat unpredictable and can vary from as little as a few minutes up to several days.

The most preferred method for making a dry catalyst blend in accordance with this invention comprises coagulation of the colloidal catalyst of the 3,904,792 or 3,874,882 patents by the addition of a suitable base in an amount sufficient to exceed the precipitation point. In the absence of excess halide ion, above pH 1, the catalyst components begin to coagulate and drop out of solution. At pH 3 and above, all catalyst components will drop out of solution, the colloid by coagulation and the excess stannous by precipitation in a form believed to be a hydrolysis product, though some stannous halide will also precipitate with catalyst having excess halide ions, and the maximum precipitation point of 3.5, precipitation and coagulation will not occur until the pH exceeds 3.5. As the pH is increased further, the rate of coagulation and precipitation is accelerated, though at pH above 8.0, the catalyst components go into solution. Thus, a preferred range of pH is from 4 to 8. Suitable bases for effecting neutralization comprise alkali metal, alkaline earth metal and ammonium hydroxides, carbonates, bicarbonates, and other materials as would be obvious to one skilled in the art that do not destroy the colloidal catalytic particles. The dry catalyst will also contain the products of neutralization such as alkali, alkaline earth metal or ammonium halides.

The addition of base to the acidic liquid colloidal catalyst causes an exothermic reaction. Care must be taken since high temperatures during this stage of the process, e.g., about 140° F or 150° F or higher can adversely affect the redispersibility of the colloidal catalyst, at least temporarily. The rate of addition of the alkaline material is preferably controlled so that the temperature of the liquid mixture is not allowed to go over about 120° F preferably not over 90° F.

The catalyst which is obtained by the above alkaline precipitation process may or may not have the same or similar chemical composition or physical structure as that of the catalyst in the liquid mixture prior to precipitation. Obviously, some change occurs since the precipitated material can no longer be held dispersed by the liquid. It may be that some or all of the salts hydrolyze to some degree or undergo some other reaction as the pH is raised. At any rate, upon redispersion of the dried catalyst, it essentially immediately behaves in the same manner as it would have if it had never been subjected to the precipitation and drying steps of the present invention. Without desiring to be bound by any particular theory as to how the present invention works, it is quite apparent that the reactions that take place to form the precipitate are pH dependent and easily reversible.

After the catalyst has been precipitated, it is separated from the supernatant liquid. This may be accomplished by simple decantation, by centrifugation, by filtration or by other means known in the art. Once separated from the supernatant liquid, the precipitate will still be wet, and will need to be dried. This too may be accomplished by many ways previously known in the art. Air drying, with or without heat, oven drying, and vacuum evaporation are but some of the available techniques. Following this procedure, it is desirable not to allow the material to become too hot or excessively dehydrated. Its ability to be fully redispersed can be adversely affected if it is allowed to reach a temperature substantially above 140°–150° F, if it is dried too quickly or if the material is over-dried. About 2 to 25%, preferably 5–15% by weight moisture should be left in the substantially solid material. It is easily determined if the material is being dried too quickly or over-dried, by stirring a small sample in 4 N HCl and observing whether the sample is fully dispersed. The preferred method of drying the precipitate is by vacuum evaporation with the material in a minimal time, and the vacuum prevents air oxidation of the stannous ions.

The dried colloidal catalysts obtained by the aforesaid methods are quickly repeptized by aqueous acidic solutions, and are essentially immediately active to catalyze conductive, non-conductive, or semiconductive surfaces. Acids which are suitable for use in the original formation of the liquid are also suitable for repeptizing the solid catalyst of the present invention, the hydrohalic acids, particularly hydrochloric and hydrobromic being preferred. The solid catalyst need not be repeptized to give the same liquid concentrations of components as was present in the liquid from which it was made. Rather, a wide range of functional liquids can be made using the solid catalyst at various concentrations in the peptizing liquid. Generally, sufficient solid catalyst should be used per liter of peptizing liquid to give from about 0.0001 to 0.3 moles per liter of the catalyzing metal, preferably from 0.0005 to 0.05 moles per liter.

The dry catalyst compositions contain excess stannous in the form of a stannous salt and may also contain urea. Consequently, the dry catalysts are hydroscopic. If the dry catalyst is to be stored for any length of time, it should be stored to avoid contamination by adsorbed water vapor such as by addition of a dessicant, e.g., magnesium chloride, to the package.

The following examples will better illustrate the invention. In the examples that follow, examples 1 to 4 serve the purpose of illustrating the derivation of FIGS. 1 and 2 of the drawings and examples 5 to 11 illustrate typical liquid catalyst formulations that may be dried in accordance with the subject invention.

EXAMPLES 1 - 4

These examples illustrate the preparation of catalyst used for the derivation of FIGS. 1 and 2 of the drawings are the equivalent to examples 1 to 4 of the 3,904,792 patent.

Four stock solutions were prepared and labeled sequentially 1 to 4.

The solutions had compostion as follows:

| Solution No. | 1 | 2 | 3 | 4 |
|---|---|---|---|---|
| Palladium chloride (gm) | 1 | 1 | 1 | 1 |
| Stannous chloride (gm) | 10 | 25 | 50 | 75 |
| Hydrochloric acid (37%-ml) | 80.6 | 80.6 | 80.6 | 80.6 |
| Water | | to 1 liter | | |

The formulations were prepared by dissolving the palladium chloride in the hydrochloric acid and half the water. Stannous chloride was then added very slowly with stirring and the resulting solution was permitted to age until a dark brown coloration was obtained. The remaining water was then added. The pH of the resulting solution was 0.

Each of the above formulations was divided into ten equal portions (100 ml each) and lithium chloride added to each to bring the total concentration to a desired amount. Each of the so-formed catalysts were then titrated with sodium bicarbonate to neutralize the acid to a point where a precipitate formed. This was considered to be the precipitation point. The chloride introduced from each of the hydrochloric acid, the stannous chloride and the lithium chloride as well as total chloride and precipitation point are set forth in the following table. With reference to the table, it should be understood that the chloride concentrations are set forth in moles per 100 ml of solution though in FIG. 1 of the drawings, this has been converted to moles per liter. Moreover, the first point in the curve represents a known precipitation point for a catalyst having a pH of 0.9 and was derived from formulation having a higher initial concentration of hydrochloric acid.

| Solution Identification | $[Cl^-]_{HCl}$ | $[Cl^-]_{SnCl_2}$ | $[Cl^-]_{LiCl}$ | $[Cl^-]_T$ | Precipitation Point (pH) |
|---|---|---|---|---|---|
| 1-1 | .100 | .010 | 0 | .110 | 1.3 |
| 1-2 | .100 | .010 | .090 | .200 | 1.7 |
| 1-3 | .100 | .010 | .190 | .300 | 1.9 |
| 1-4 | .100 | .010 | .290 | .400 | 2.3 |
| 1-5 | .100 | .010 | .390 | .500 | 2.7 |
| 1-6 | .100 | .010 | .490 | .600 | 3.0 |
| 1-7 | .100 | .010 | .590 | .700 | 3.3 |
| 1-8 | .100 | .010 | .690 | .800 | 3.5 |
| 2-1 | .100 | .026 | 0 | .126 | 1.1 |
| 2-2 | .100 | .026 | .074 | .200 | 1.4 |
| 2-3 | .100 | .026 | .174 | .300 | 1.7 |
| 2-4 | .100 | .026 | .274 | .400 | 2.1 |
| 2-5 | .100 | .026 | .374 | .500 | 2.3 |
| 2-6 | .100 | .026 | .474 | .600 | 2.5 |
| 2-7 | .100 | .026 | .574 | .700 | 2.8 |
| 2-8 | .100 | .026 | .674 | .800 | 3.1 |
| 3-1 | .100 | .052 | 0 | .152 | 1.1 |
| 3-2 | .100 | .052 | .048 | .200 | 1.3 |
| 3-3 | .100 | .052 | .148 | .300 | 1.6 |
| 3-4 | .100 | .052 | .248 | .400 | 1.9 |
| 3-5 | .100 | .052 | .348 | .500 | 2.0 |
| 3-6 | .100 | .052 | .448 | .600 | 2.3 |
| 3-7 | .100 | .052 | .548 | .700 | 2.5 |
| 3-8 | .100 | .052 | .648 | .800 | 2.7 |
| 4-1 | .100 | .078 | 0 | .178 | 1.2 |
| 4-2 | .100 | .078 | .022 | .200 | 1.2 |
| 4-3 | .100 | .078 | .122 | .300 | 1.4 |
| 4-4 | .100 | .078 | .222 | .400 | 1.6 |
| 4-5 | .100 | .078 | .322 | .500 | 1.7 |
| 4-6 | .100 | .078 | .422 | .600 | 1.9 |
| 4-7 | .100 | .078 | .522 | .700 | 2.0 |
| 4-8 | .100 | .078 | .622 | .800 | 2.3 |

The curves of FIG. 1 are approximations as the precipitation point was observed visually and subject to experimental error. The explanation of the results of this series of experiments is set forth above and will not be repeated here.

| | |
|---|---|
| Example 5 | |
| Palladium chloride | 1 gm |
| Stannous chloride | 25 gm |
| Hydrochloric acid (12N) | 12 ml |
| Sodium chloride | 58 gm |
| Water | 900 ml |
| Example 6 | |
| Palladium nitrate | 1 gm |
| Stannous nitrate | 25 gm |
| Nitric acid | 20 ml |
| Calcium chloride | 100 gm |
| Water | 900 ml |
| Example 7 | |
| Platinum chloride | 1 gm |
| Stannous chloride | 25 gm |
| Hydrochloric acid (12N) | 10 ml |
| Sodium chloride | 200 gm |
| Water | 900 ml |

-continued

| | |
|---|---|
| Example 8 | |
| Rhodium chloride | 1 gm |
| Stannous chloride | 30 gm |
| Sulfuric acid (96%) | 10 ml |
| Sodium chloride | 200 gm |
| Water | 900 ml |
| Example 9 | |
| Palladium chloride | 1 gm |
| Stannous chloride | 20 gm |
| Hydrochloric acid (12N) | 100 ml |
| Sodium chloride | 100 gm |
| Urea | 50 gm |
| Water | 900 ml |
| Example 10 | |
| Palladium chloride | 1 gm |
| Stannous chloride | 20 gm |
| Hydrochloric acid (12N) | 100 ml |
| Urea | 50 gm |
| Water | 900 ml |

In the above examples, for the most part, the formulations were prepared by dissolving the catalytic metal salt in the acid and 300 ml of water. A second solution comprising the stannous salt dissolved in 300 ml of water was then added to the first solution with stirring and permitted to age until a dark coloration was obtained. The remaining water containing a halide salt and urea, where indicated, was then added.

EXAMPLE 11

Using the formulation of example 5, the stannous chloride is dissolved in the hydrochloric acid diluted with an equal volume of water. The palladium chloride is added and dissolved and the remainder of the water in which the sodium chloride is dissolved is added. The resulting solution is heated to 85° C for 20 minutes, boiled for 1.5 hours and then cooled.

EXAMPLE 12

Using the catalyst formulation of example 5, 50 ml of said solution was added to a petri dish having a height of ½ inch and a diameter of 5 inches. The catalyst was allowed to stand in the petri dish open to air for about one week, a time sufficient for all the components of the catalyst to evaporate. At the end of the week, a dry frangible film could be scraped from the bottom of the petri dish. This material was ground to a fine powder using a mortar and pestle and then subdivided into three equal portions, each weighing approximately 1.5 grams. Three separate solutions were then prepared, each containing 15 ml of concentrated hydrochloric acid and 30 ml of water in a 50 ml beaker. These solutions were labeled solutions 1, 2 and 3, respectively. The first portion of the dried and ground catalyst was added to solution 1 and stirred. Following stirring, after about 10 minutes, a black precipitate could be observed on the bottom of the beaker containing solution 1 leaving a brackish appearing supernatent liquid above the precipitate containing some suspended material.

The second portion of the dried and ground catalyst was mixed with 2 grams of stannous chloride powder and added to solution 2. A dark brown composition was obtained that was stable for more than 24 hours. No precipitate could be observed of the beaker containing solution 2.

Two grams of stannous chloride were dissolved in solution 3 and the third portion of the dried and ground catalyst was then added thereto. A dark brown solution was formed that, like the catalyst formed in solution 2, was stable for a period of in excess of 24 hours.

Each of the aforesaid solutions was tested for catalytic activity by immersing a prepared phenolic plastic plaque in each of the catalytic solutions for a period of five minutes. Following catalysis, each plaque was immersed in a mild acid accelerator and then in a standard electroless copper plating solution for ten minutes. A copper deposit was detectable on the plaque immersed in the solution 1, though coverage was uneven. Excellent copper deposition was achieved for the catalysts of solutions 2 and 3. It is believed that some stannous was left in the original dried sample, though the amount was limited such that the material was commercially unacceptable.

EXAMPLE 13

The procedure of example 12 is repeated substituting the catalyst of example 7 for the catalyst of example 5 with similar results.

EXAMPLE 14

An Erlenmeyer flask was charged with 200 ml of the catalyst of example 6. The flask was equipped with a condensor and connected to a vacuum pump to create a vacuum over the catalyst. The catalyst was heated to 150° F and dried to solid dry film over a period of several hours. The dry film of catalyst was scraped from the bottom of the flask and ground to a fine powder using a mortar and pestle. A solution was prepared comprising 30 ml of nitric acid and 150 ml of water. The dried and ground catalyst was added to the solution to form a dark brown solution stable for a period in excess of 24 hours. Following the procedures set forth in example 12, the catalyst solution was found to possess full catalytic activity.

EXAMPLE 15

The procedure of example 14 was repeated substituting a nitrogen atmosphere for the vacuum of example 14. The drying period was increased to six hours. Again, a fully functional catalyst solution was obtained following redispersion.

EXAMPLE 16

The procedure of example 14 was repeated using the catalyst formulation of example 8. Similar results were obtained.

EXAMPLE 17

The procedure of example 14 was repeated using the catalyst formulation of example 11. Similar results were obtained.

EXAMPLE 18

A mixture of 0.1 grams of palladium chloride, 4 grams of stannous chloride, 25 grams of lithium chloride and 10 grams of urea was dampened with 15 ml of concentrated hydrochloric acid and ground together with a mortar and pestle. The mixture of powders was permitted to stand for one hour during which period of time, the powders changed from green to dark brown. The mixture was then heated to about 140° F to drive off the hydrochloric acid and reground to a fine powder.

A solution was prepared comprising 35 ml of concentrated hydrochloric acid and 65 ml of water. The dry powder was added to the solution with stirring to form a dark brown solution stable for a period of in excess of 24 hours. The catalytic activity of the solution was tested immediately after preparing the solution, one hour after preparing the solution and 24 hour after preparing the solution, each test following the procedure of example 12 above. In each case, catalytic activity was observed. Copper coverage over the phenolic plaque catalyzed immediately after preparing the solution was poor, but was substantially improved after 24 hours. After 24 hours, full catalytic activity was obtained.

EXAMPLE 19

Using the catalyst of example 9, 200 ml of said catalyst were neutralized by the addition of sodium hydroxide until a pH of 7 was achieved. At this pH, a black precipitate was observed on the bottom of the container holding said catalyst and the supernatant liquid over said precipitate was water-white and clear. The liquid was decanted and the precipitate was collected and dried by infra-red heating. A solution was prepared comprising 50 ml of concentrated hydrochloric acid and 130 ml of water. The precipitate was redispersed in the solution and catalytic activity was determined by the procedures of example 12 above. The catalyst was found to be fully functional and was stable for a period of in excess of 24 hours.

EXAMPLE 20

The procedure of example 19 was repeated using the catalyst of example 11. Similar results were obtained.

EXAMPLE 21

The procedure of example 19 was repeated with the catalyst of example 10 with substantially the same results.

EXAMPLE 22

Using the catalyst of example 6, 5 mls were placed in an ultracentrifuge tube which was stoppered and spun in an ultracentrifuge for 24 hours at 25,000 RPM using a 6 inch rotor. A brown-black residue was obtained on the bottom of the tube. The liquid above this residue was water-white and free of palladium. This confirms the colloidal nature of the catalyst of example 9.

The supernatent liquid above the residue was decanted and the residue removed. This was dried using infra-red heating to yield a frangible mass that was readily ground to a fine powder.

A solution was prepared containing 5 ml of concentrated hydrochloric acid and 15 ml of water. The dried catalyst powder was stirred into the solution to yield a stable, functional catalyst composition.

EXAMPLE 23

The procedure of example 22 was repeated using the catalyst of example 10. Similar results were obtained.

EXAMPLE 24

The procedure of example 22 was repeated using the catalyst of example 6. Similar results were obtained.

The dry catalysts of this invention have a formulation dependent upon the manner in which they are produced though all are believed to have common components. For example, all contain the catalytic metal in a colloidal reduced form if the catalyst is made by the reduction of the catalytic metal by stannous tin to yield reduced colloidal catalyst and stannic tin as well as what is believed to be a stannic acid protective colloid. If the procedures of U.S. Pat. No. 3,672,938 are capable of making a true solution complex catalyst, then such catalyst in dry form would be the precipitate of said complex, if not converted to colloidal form during drying, and also contains stannic tin. All catalysts in dry form contain tin compounds in some form, a portion of which is stannic tin. All possess a tin content, such that the tin to catalytic metal molar ratio is at least 2:1. For all catalyst containing extraneous halide ions, the corresponding dry catalyst will contain the corresponding halide salt. To all catalyst to which urea has been added, the corresponding catalyst will contain urea. If both the extraneous halide ions and urea are added to the liquid catalyst formulations, all corresponding dry catalyst will likewise contain the salt of the extraneous halide ions and urea, though the urea may be in the form of an addition product as described above. The balance of the dry catalyst composition is dependent upon the manner in which said composition is formed.

If the liquid catalysts are dried taking precaution to avoid substantial aerial oxidation of stannous tin, then the dried catalyst composition will contain, in addition to the above common components, a stannous salt as well as some hydrolysis products of the stannous salt. If stannous tin is oxidized during drying, then instead of a stannous salt and its hydrolysis products, the dry products will have a substantially and correspondingly greater concentration of stannic tin. Stannous salt may be added to such dry composition as described above.

If the dry catalysts are formed by neutralization rather than drying as described above, then the dry composition will contain, in addition to the aforesaid components, the salts formed as a result of the neutralization reaction—e.g., sodium chloride if the catalyst is neutralized with sodium hydroxide. In addition, the dry composition will contain a stannous salt and hydrolysis products thereof.

Finally, if the dry composition is formed by blending dry powders, then the dry composition will contain, in addition to the common components, a larger concentration of a stannous salt, but should be substantially free of hydrolysis products of the stannous salt.

In addition to the uses of the dry catalyst claimed herein, other uses are possible. For example, the dry material can be incorporated into a plastic substrate by blending the dry material with powders of the plastic before fabricating the plastic sheet. For example, from 0.1 to 5% by weight of the dry catalyst can be blended with plastic powders, e.g., powders of ABS and molded to shape to provide a plateable ABS substrate. Alternatively, the catalyst powders may be blended with a solvent and impregnated into the surface of a plastic sheet or an adhesive and adhered to the surface. In each embodiment, a catalytic surface is provided.

I claim:

1. An essentially dry composition which, upon admixture with an aqueous acid solution having a pH of less than the precipitation point of the catalyst, forms a stable catalyst composition for catalyzing a substrate prior to the deposition of an electroless metal, said solution containing sufficient halide ions to render the same stable and catalytic, said halide ions being derived from said aqueous acid with which said dry composition is mixed, said dry composition or the combination resulting from mixing said aqueous acid with said dry composition, said essentially dry compositions comprising a catalytic metal in combination with tin compounds where at least a portion of said tin compounds is in stannous form in an amount whereby the molar ratio of stannous tin to catalytic metal is at least 2:1, and a member selected from the group of urea in an amount of at least one mole per ten moles of acid with which said dry composition is mixed, an extraneous halide salt in an amount of at least 0.2 moles in excess of that provided by all catalyst components including the acid with which the dry composition is mixed and mixtures thereof.

2. The composition of claim 1 where the catalytic metal is in a colloidal reduced form, insoluble in acid solution.

3. The composition of claim 1 where, at least in part, the catalytic metal is complexed with the tin compounds.

4. The composition of claim 1 containing stannous tin in the form of a member selected from the group of stannous halides, their hydrolysis products and mixtures thereof.

5. The composition of claim 1 containing stannous tin in the form of a mixture of stannous halide and its hydrolysis products.

6. The composition of claim 5 having chloride as the halide common to all catalyst components.

7. The compositions of claim 5 where the ratio of the stannous tin to the catalytic metal is at least 5:1.

8. The composition of claim 7 where the dried composition has a moisture content of between 2 and 25% by weight.

9. The composition of claim 7 where the urea to acid ratio varies between 1:1 and 10:1.

10. The composition of claim 9 where the catalytic metal is from the platinum family of metals.

11. The composition of claim 7 where said member is a mixture of urea and an extraneous halide salt.

12. The composition of claim 11 where the urea to acid ratio varies between 1:1 and 10:1.

13. The composition of claim 11 where the concentration of the extraneous halide salt varies from an excess of 0.5 moles to saturation.

14. The composition of claim 11 where the extraneous halide salt is a member selected from the group of alkali metal salts, alkaline earth metal salts and ammonium salts.

15. The composition of claim 14 where the halide salt is sodium chloride.

16. The composition of claim 14 where the catalytic metal is from the platinum family of metals.

17. The composition of claim 7 where said member is an extraneous halide salt.

18. The composition of claim 17 where the concentration of the extraneous halide salt varies from an excess of 0.5 moles to saturation.

19. The composition of claim 17 where the extraneous halide salt is a member selected from the group of alkali metal salts, alkaline earth metal salts and ammonium salts.

20. The composition of claim 19 where the salt is sodium chloride.

21. The composition of claim 19 where the catalytic metal is from the platinum family of metals.

22. An essentially dry composition which, upon admixture with an aqueous acid solution having a pH of less than the precipitation point of the catalyst, forms a stable catalyst composition for catalyzing a substrate prior to the deposition of an electroless metal, said solution containing sufficient halide ions to render the same stable and catalytic, said halide ions being derived from said aqueous acid with which said dry composition is mixed, said dry composition or the combination resulting from mixing said aqueous acid with said dry composition, said essentially dry composition comprising palladium in combination with tin compounds where at least a portion of said tin compounds is in stannous form in an amount whereby the molar ratio of stannous tin to palladium is at least 2:1, and a member selected from the group of urea in an amount of at least one mole per ten moles of acid with which said dry composition is mixed, an extraneous halide salt in an amount of at least 0.2 moles in excess of that provided by all catalyst components including the acid with which the dry composition is mixed and mixtures thereof.

23. The composition of claim 22 where the palladium is in colloidal reduced form, insoluble in acid solution.

24. The composition of claim 23 where the halide ions are chloride ions.

25. The composition of claim 24 containing stannous tin in the form of a member selected from the group of stannous chloride, their hydrolysis products and mixtures thereof.

26. The composition of claim 25 containing stannous tin in the form of a mixture of stannous chloride and its hydrolysis products.

27. The compositions of claim 25 where the ratio of the stannous tin to the catalytic metal is at least 5:1.

28. The composition of claim 25 containing a protective stannic acid colloid for the palladium colloid.

29. The composition of claim 24 where the dried composition has a moisture content of between 2 and 25% by weight.

30. The composition of claim 22 where the urea to acid ratio varies between 1:1 and 10:1.

31. The composition of claim 24 where said member is a mixture of urea and an extraneous chloride salt.

32. The composition of claim 31 where the urea to acid ratio varies between 1:1 and 10:1.

33. The composition of claim 31 where the concentration of extraneous halide ions varies from an excess of 0.5 moles to saturation.

34. The composition of claim 31 where the extraneous chloride salt is a member selected from the group of alkali metal chlorides, alkaline earth metal chlorides and ammonium chlorides.

35. The composition of claim 34 where the halide salt is sodium chloride.

36. The composition of claim 22 where said member is an extraneous chloride salt.

37. The composition of claim 36 where the concentration of the extraneous halide salt varies from an excess of 0.5 moles to saturation.

38. The composition of claim 36 where the extraneous chloride salt is a member selected from the group of alkali metal chlorides alkaline earth metal chlorides and ammonium chlorides.

39. The composition of claim 38 where the salt is sodium chloride.

40. A process for the formation of an essentially dry composition which, upon admixture with an aqueous acid solution having a pH less than the precipitation point of the catalyst, forms a stable catalyst composition for catalyzing a substrate prior to deposition of an electroless metal, said solution containing sufficient halide ions to render the same stable and catalytic, said halide ions being derived from said aqueous acid with which said dry composition is mixed, said dry composition or the mixture resulting from mixing said aqueous acid with said dry composition, said process comprising the steps of providing a liquid catalyst composition that is the product resulting from the admixture of an acid solution of a catalytic metal salt, a stannous salt in molar excess of the catalytic metal salt, and a member selected from the group of urea in an amount of at least one mole per ten moles of acid with which the dry composition is mixed, an extraneous halide salt in an amount of at least 0.2 moles in excess of that provided by all catalyst components including the acid with which the dry composition is mixed and mixtures thereof, said liquid catalyst composition having a pH below its precipitation point; drying said liquid catalyst composition under conditions whereby substantial oxidation of stannous ions from said stannous salt is encountered; and mixing a stannous salt with the product obtained by drying, said stannous salt being added in an amount such that the ratio of stannous tin to catalytic metal is at least 2:1.

41. The process of claim 40 where the ratio of the stannous salt to the catalytic metal salt is at least 5:1.

42. The process of claim 40 where the catalytic metal is palladium.

43. The process of claim 42 where a portion, at least, of any halide salts are chloride salts.

44. The process of claim 40 where the urea to acid ratio varies between 1:1 and 10:1.

45. The process of claim 42 where said member is a mixture of urea and an extraneous halide salt.

46. The process of claim 45 where the urea to acid ratio varies between 1:1 and 10:1.

47. The process of claim 45 where the concentration of the extraneous halide salt varies from an excess of 0.5 moles to saturation and the salt is a chloride salt.

48. The process of claim 47 where the extraneous halide salt is sodium chloride.

49. The process of claim 42 where said member is an extraneous halide salt.

50. The composition of claim 49 where the concentration of the extraneous halide salt varies from an excess of 0.5 moles to saturation and the salt is a chloride salt.

51. The composition of claim 50 where the salt is sodium chloride.

52. The product formed by the process of claim 45.

53. The product formed by the process of claim 49.

54. A process for making a catalyst composition for catalyzing a substrate prior to electroless metal deposition, said process comprising dispersing the product of claim 45 in an acid solution having a pH less than 3.5.

55. A process for making a catalyst composition for catalyzing a substrate prior to electroless metal deposition, said process comprising dispersing the product of claim 49 in a hydrochloric acid solution having a pH less than about 3.5.

56. A plastic substrate having the catalyst composition of claim 1 dispersed throughout at least its surface.

57. A plastic substrate having the catalyst composition of claim 17 dispersed throughout at least its surface.

58. A plastic substrate having the catalyst composition of claim 22 dispersed throughout at least its surface.

59. A plastic substrate having the catalyst composition of claim 27 dispersed throughout at least its surface.

* * * * *